US009982492B2

(12) United States Patent
Hanton et al.

(10) Patent No.: US 9,982,492 B2
(45) Date of Patent: May 29, 2018

(54) DOWNHOLE SWIVEL SUB

(71) Applicant: TERCEL IP LTD., Road Town, Tortola (VG)

(72) Inventors: John Hanton, Aberdeenshire (GB); Graeme Thomas Marr, Aberdeenshire (GB); Jeffrey B. Lasater, Houston, TX (US)

(73) Assignee: Tercel IP Ltd., Road Town, Tortola (VG)

( * ) Notice: Subject to any disclaimer, the term of this patent is extended or adjusted under 35 U.S.C. 154(b) by 0 days. days.

(21) Appl. No.: 15/110,771

(22) PCT Filed: Jan. 9, 2015

(86) PCT No.: PCT/EP2015/050356
§ 371 (c)(1),
(2) Date: Jul. 11, 2016

(87) PCT Pub. No.: WO2015/104389
PCT Pub. Date: Jul. 16, 2015

(65) Prior Publication Data

US 2016/0326812 A1 Nov. 10, 2016

(30) Foreign Application Priority Data

Jan. 10, 2014 (EP) ..... 14000115
Jan. 16, 2014 (EP) ..... 14151499

(51) Int. Cl.
*E21B 17/05* (2006.01)
*E21B 17/10* (2006.01)
*E21B 33/14* (2006.01)

(52) U.S. Cl.
CPC ..... *E21B 17/05* (2013.01); *E21B 17/1078* (2013.01); *E21B 33/14* (2013.01)

(58) Field of Classification Search
CPC ..... E21B 17/05; E21B 17/1078; E21B 33/14
USPC ..... 166/285
See application file for complete search history.

(56) References Cited

U.S. PATENT DOCUMENTS 4,869,323 A 9/1989 Stagg
7,011,162 B2 * 3/2006 Maguire ..... E21B 17/05 166/242.6
8,191,639 B2 * 6/2012 Howlett ..... E21B 17/05 166/237

(Continued)

FOREIGN PATENT DOCUMENTS

CA 2256069 A1 6/2000

*Primary Examiner* — William D Hutton, Jr.
*Assistant Examiner* — Ashish K Varma
(74) *Attorney, Agent, or Firm* — Lloyd L. Davis; Hunton Andrews Kurth LLP

(57) ABSTRACT

The invention relates to a swivel sub for a string to be lowered into a wellbore and a method of operation in a wellbore, wherein such swivel sub is used and comprises: —a first end provided with connection means for connecting a bottom section of a string; —a second end provided with connection means for connecting an upper section of the string; —a first member, including the first end and a sleeve portion opposed to the first end; —a second member including the second end and comprising a section opposed to the second end and partially located within the sleeve portion; the first member and the second member being arranged to rotate relative to each other.

13 Claims, 4 Drawing Sheets

(56) References Cited

U.S. PATENT DOCUMENTS

| | | | |
|---|---|---|---|
| 8,511,392 | B2 | 8/2013 | Howlett et al. |
| 2011/0108266 | A1 | 5/2011 | Smith et al. |

* cited by examiner

DOWNHOLE SWIVEL SUB

OBJECT OF THE INVENTION

The present invention relates to a swivel sub for connecting two sections of a string to be deployed within a wellbore and a method of operation in a wellbore including a step of deploying a string provided with such a swivel sub.

TECHNICAL FIELD

Realization of an oil or gas well involves steps of drilling a wellbore and steps of completion of the drilled wellbore. Typically, a wellbore is drilled in a few steps. A first portion of the wellbore is drilled using a large diameter drilling tool. When the drilling of the first portion of the wellbore is accomplished, a casing string is lowered down into the drilled portion of the wellbore. A casing string is a tubular assembly of casing pipes assembled at the surface of the well. Advantageously, a casing shoe is screwed at the bottom of the casing string and provides a rounded profile to the bottom of the casing string, which helps to guide the casing string into the drilled portion and to get through any ledge or obstruction in the drilled portion. The casing string may be also provided with centralizers for centralizing the casing string into the borehole. The casing shoe is generally drillable for allowing the drilling of a subsequent portion of the wellbore. When the casing string reaches the bottom of the drilled portion, a further step of cementing the casing string against the wall of the borehole is performed. The main functionalities of a cemented casing in a wellbore are:

- stabilization of the wellbore, particularly if the wellbore crosses some unstable formations, in which case the casing prevents the formation wall from caving into the wellbore;
- isolating incompatible formations or zones, for example isolating ground water from contamination of another formation or isolating zone having different pressures;
- providing strong foundations allowing using high-density and/or highly pressurized drilling fluids;
- providing a smooth borehole facilitating the insertion of a downhole tool, such as a drill bit, a screen or a liner, and reducing the risk of the downhole tool becoming stuck.

Once a first portion of the wellbore has been drilled and stabilized by cemented casings, the same steps of drilling and casing cementation are performed using decreasing diameter drill bits and decreasing diameter casing strings.

The last casing string portion is called the production casing. The production casing generally does not extend from the surface of the wellbore to the bottom of the wellbore, but extends from the bottom of an upper cased portion of the wellbore to the bottom of the wellbore. Such a casing string is also called a liner. The liner is attached to a workstring and lowered in the deepest borehole portion of the well. Then, the liner is attached to the walls of an upper cemented casing portion of the wellbore by a liner hanger. The liner is cemented and a cased hole sealed off from natural fluids is obtained. The production casing passes through the zone containing the oil or gas.

Once the wellbore is cemented by casing, a perforation tool is lowered into the zone of interest and holes are blasted through the walls of the casing, through the cement sheath and through about one meter into the formation rock. The casing is generally not used as a conduit for bringing oil and gas to the surface. This operation is performed by inserting through the casing a production tubing that comprises a packer at the bottom. The packer is expanded in the annulus comprised between the production tubing and the casing, some way up from the perforated zone, for sealing off the tubing from the casing.

Operation in a wellbore includes the steps of insertion and cementation of the casing string and also some further steps of perforation, stimulation, gravel packing and tubing, involving the insertion of specific tools. For example, when the wellbore crosses some weak subterranean formations such as sandstone, tools like sand control screens are attached to a workstring and lowered into the wellbore for maintaining the structure of the reservoir around the wellbore. Mixing of sand and fluid leads to the creation of an abrasive fluid. A sand control screen acts like a filter that allows ingress of reservoir fluid to the production string while preventing migration of sand into the wellbore and erosion of equipment that would be exposed to abrasive fluid. Sand control screens are quite delicate and easily susceptible to damage during deployment of the string into the wellbore.

For lowering strings like casing strings, liners, completion strings or production strings, into a deep and highly deviated wellbore, there is often insufficient string down weight available to the operator to place the string into the well without rotating the string to break the friction. Applying too much downhole weight can over-compress the pipe below, thereby causing damage. It is advantageous to rotate the workstring when inserting in high angle/ERD (extended reach drilling) or tortuous wells due to the fact that the associated drag of the friction is reduced in the string, making it easier to observe and apply the necessary measured down weight to aid getting the bottom of the workstring to the planned depth. However, it is often not desirable to rotate the bottom section of the string (that may comprise delicate accessories) for fear of damage. For example, if a completion tool, or bottom casing or liner sticks, buckling can occur as a result of the applied torque.

In oil and gas field, the realization of a wellbore requires some steps wherein it is advantageous to rotate a first portion of a string relative to a second string portion. For example, the applicant has developed and commercialized a swivel sub described in U.S. Pat. No. 8,511,392 and a method using a swivel sub for some operation in a wellbore as disclosed in U.S. Pat. No. 8,191,639.

U.S. Pat. No. 8,191,639 describes a method of running a screen or a liner into a wellbore, the method comprising the steps of:

- locating a swivel sub between a workstring and a liner or screen assembly;
- rotating the workstring with the swivel sub in a first position, such that the workstring rotates while the liner or screen assembly remains stationary;
- running the workstring into the wellbore while rotating the workstring with the swivel in the first position;
- creating a positive pressure differential in the swivel sub to switch the sub into a second position, such that the workstring and at least a portion of the liner or screen assembly rotates together, and;
- rotating the workstring and the portion of the liner or screen assembly.

When the swivel is used for lowering down a liner, since the swivel provided in this method is operated by a differential of pressure between the bore of the swivel and the annulus comprised between the workstring and the wellbore, it is not suitable to perform cementation of the liner with such a swivel included in the workstring. A release mechanism is generally provided between the swivel and the liner.

Applicant's swivel sub as described in said US patents comprises a first tubular body connectable to a lower portion of a string and a second tubular body connectable to an upper portion of a string and surrounding partially the first body. The swivel sub further comprises a locking sleeve surrounding both the first tubular body and the second tubular body.

The first tubular body and the second tubular body both comprise a set of coupling splines arranged on their external surface, and the locking sleeve comprises a set of coupling splines arranged in its internal surface. In a first position, the locking sleeve is secured to the first tubular body by a sheer pin and the splines of the locking sleeve are disengaged from the splines of the second tubular body, allowing rotation of the second tubular body relative to the first body. By applying a pressure differential between the bore of the swivel sub and the annulus formed by the string and the wellbore, the locking sleeve moves to a second position wherein the coupling splines of the locking sleeve engages the coupling splines of the second body and the ones of the first body, so that the torque provided on the housing is transmitted to the mandrel. A locking dog is further provided in the locking sleeve for locking the locking sleeve in its second position.

This swivel sub is used for example in a method of running a string in a wellbore, wherein the bottom of the string comprises fragile elements that are not suitable to rotate. Such elements can be for example a liner, a screen or a gravel pack assembly. Therefore, the string including such elements is deployed into the wellbore in a first step wherein the portion of the string upper the swivel sub is rotated while the portion of the string under the swivel sub is not rotated. Rotation of the string breaks the friction between the string portion upper the swivel and the wall of the wellbore, allowing the string to be deployed in deeper areas without damaging the fragile elements under the swivel sub. When it is needed to rotate the string section under the swivel sub, a pressure differential is applied between the bore of the swivel sub and the annulus for moving the sliding sleeve to its second position.

Once the downhole element such as a liner or a screen or a gravel pack assembly is installed at the desired position in the wellbore, the workstring including the swivel sub is disconnected from the downhole element. The downhole element is generally connected to the workstring by a release mechanism. The swivel sub is retrieved at the surface of the wellbore and the locking sleeve is reset in its first position. The external location of the locking sleeve advantageously allows an easy access for resetting the locking sleeve in its first position simply by unscrewing the locking dog and by inserting a new sheer pin between the locking sleeve and the first tubular body for a further use of the swivel sub.

Some other steps of realization of a wellbore require rotating the whole string before unlocking the rotation of an upper string section from a lower string section.

Document U.S. Pat. No. 7,011,162 discloses a swivel apparatus comprising a top body formed by a mandrel and a housing, and a bottom body partially included between the mandrel and the housing. The swivel apparatus further comprises a locking sleeve partially arranged between the housing and the bottom body. A first set of coupling splines is arranged at the inner surface of the housing, a second set of coupling splines is arranged on the external surface of the bottom body, a third set of coupling splines is arranged at the outer surface of the locking sleeve and a fourth set of splines is arranged at the inner surface of the locking sleeve. Initially, the locking sleeve is maintained by a sheer pin in a first position, wherein the external coupling splines of the locking sleeve are engaged with the coupling splines of the housing and the inner coupling splines of the locking sleeve are engaged with the coupling sleeve of the bottom body such as to transmit the torque of the top body to the second body.

The swivel apparatus disclosed in that document is used in a method of completing a wellbore, and is arranged in an assembly between an expander tool and a running tool. The assembly is fully enclosed in a liner, with the running tool mechanically connected to the liner. The running tool is located below the swivel apparatus which is located below the expander tool. When the liner is deployed into the wellbore, the whole string is rotated with the locking sleeve in its first position. Then, after activation of the expander tool, the locking sleeve is caused to move towards a second position, wherein the coupling splines of the housing and the external coupling splines of the locking sleeve are disengaged, allowing the expander tool to rotate relative to the bottom portion mechanically connected to the liner, such as to expand a portion of the liner against a preinstalled casing there around. After the liner portion has been expanded against the preinstalled casing therearound, the running tool has to be disconnected from the liner. The assembly including the expander tool, the swivel apparatus and the running tool is removed from the wellbore.

The locking sleeve further comprises a spring clip that mates into an external relief groove of the bottom body when the locking sleeve is in its second position. The external relief groove and the spring clip acts as a clutch system allowing rotation of the top body relative to the bottom body in a first direction of rotation of the top body, and locking the rotation of the bottom body with the top body while the top body is rotated in the reverse direction. This system acts like a safety back up system in case if the release mechanism for removing the running tool from the liner fails.

In the swivel apparatus disclosed in that document, the major portion of the locking sleeve is easily accessible from the outside of the tool, for facilitating maintenance and resetting the locking sleeve towards its first position after the assembly has been removed from the wellbore. Also, the locking sleeve is protected from accidental tripping since it is surrounded by the liner.

The development of the extended reach drilling requires new techniques for completing deviated wellbores extending over several kilometers.

There is also a need for a good cementation of casings, especially for horizontal deviated wellbores. A good cementation is essential for providing an efficient sealing of the cased hole.

Document U.S. Pat. No. 4,869,323 discloses a method for completing a wellbore wherein an upper part of casing is cemented while a lower part of the casing is kept uncemented. It is commonly preferred to provide cementation of the whole casing for safety reasons.

There is a further need for deploying strings, including a liner, a completion tool or production tubing within highly deviated wellbores, and even within extended reach wellbores, without risk of jamming or damaging the string or the completion tool or the production tubing.

SUMMARY OF THE INVENTION

A first aspect of the invention relates to a method of operation in a wellbore, including a step of deploying a string within the wellbore, wherein a swivel sub as defined hereafter is provided and wherein the first end of the swivel sub is connected to a bottom section of the string, the second end of the swivel sub is connected to an upper section of the string, and the upper section of the string is rotated in a first direction during deployment of the string in the wellbore while the bottom section is not rotating.

Preferably the string is provided with a centralizer comprising means for reducing drag between a wall of the wellbore and a radially external surface of the centralizer or between a radially internal wall of a casing and the radially external surface of the centralizer.

The string may be a casing string and the method may comprise a step of cementation of the casing string, during which the upper section of the casing string connected to the swivel sub is rotated.

The string may also be a liner and the method comprises a step of cementation of the liner, during which the upper section of the liner connected to the swivel sub is rotated.

The swivel sub may be cemented within the wellbore.

The string may comprise a downhole tool located at a bottom end of the string and the method may comprise a step of deploying the downhole tool at a predetermined location of the wellbore.

Preferably, the swivel sub comprises a freewheel and the upper section of the string is equipped with a release mechanism connecting an upper and a lower portion of the upper section. The release mechanism may be operated when required by rotating the upper part of the upper section in a second direction opposite to the first direction.

A second aspect of the invention relates to a swivel sub for a string to be lowered into a wellbore, the swivel sub comprising:

- a first end provided with connection means for connecting a bottom section of a string;
- a second end provided with connection means for connecting an upper section of the string;
- a first member, including the first end and a sleeve portion opposed to the first end;
- a second member including the second end and comprising a section opposed to the second end and partially located within the sleeve portion;

the first member and the second member being arranged to rotate relative to each other.

Preferably, the first member and the second member are tubular members, both first member and second member defining a bore extending from the first end to the second end of the swivel sub, the swivel sub further comprising sealing means located between the sleeve portion of the first tubular member and the section of the second tubular member for sealing the bore from the external environment.

Preferably, the swivel sub comprises thrust bearings arranged between the sleeve portion of the first member and the section of the second member.

Preferably, the swivel sub comprises a freewheel located between the first member and the second member, the freewheel being arranged such that:

- the freewheel allows rotation of the second member relative to the first member upon rotation of the second member in a first direction, and
- the freewheel engages the first member with the second member upon rotation of the second member in a direction opposite to the first direction.

The freewheel may comprise a one-way clutch element having a first saw-toothed axial end mating with a preferably complementarily shaped second saw-toothed axial end formed in the section of the second member located within the sleeve portion of the first member.

Alternatively or additionally, the freewheel comprises a sprag clutch arranged between the first member and the second member.

Preferably, the swivel sub further comprises an operable sealing system at the interface between the sleeve portion of the first tubular member and the section of the second tubular member inside the sleeve portion.

DETAILED DESCRIPTION OF THE INVENTION

The present invention is described thereafter in relation to specific embodiments that are of purely illustrative value and must not be considered as limiting. In general, the present invention is not limited to the examples illustrated and/or described hereinafter. The invention comprises each of the novel features and any combination thereof. The presence of reference numbers in the description cannot be considered to be limiting, including when these numbers are indicated in the claims.

The use of the verbs "comprise" and "include", or any other variant, and also the conjugation thereof, cannot in any way exclude the presence of elements other than those mentioned. The use of the indefinite articles "a" or "an" or the definite article "the" when introducing an element does not exclude the presence of a plurality of these elements except when the opposite is clear from the context.

The use of the term "string" in the field of the present invention means an assembly of pipes connected to each other that is lowered into a wellbore for operation in a wellbore.

In the present description, the terms "front", "lower", and "bottom" relative to the string and its components are used for "facing or moving in a direction away from an entry opening of the wellbore at the surface. The term and "upper" relative to the workstring and its components are used for "facing towards or moving in a direction towards the entry opening of the wellbore".

Figure 1:
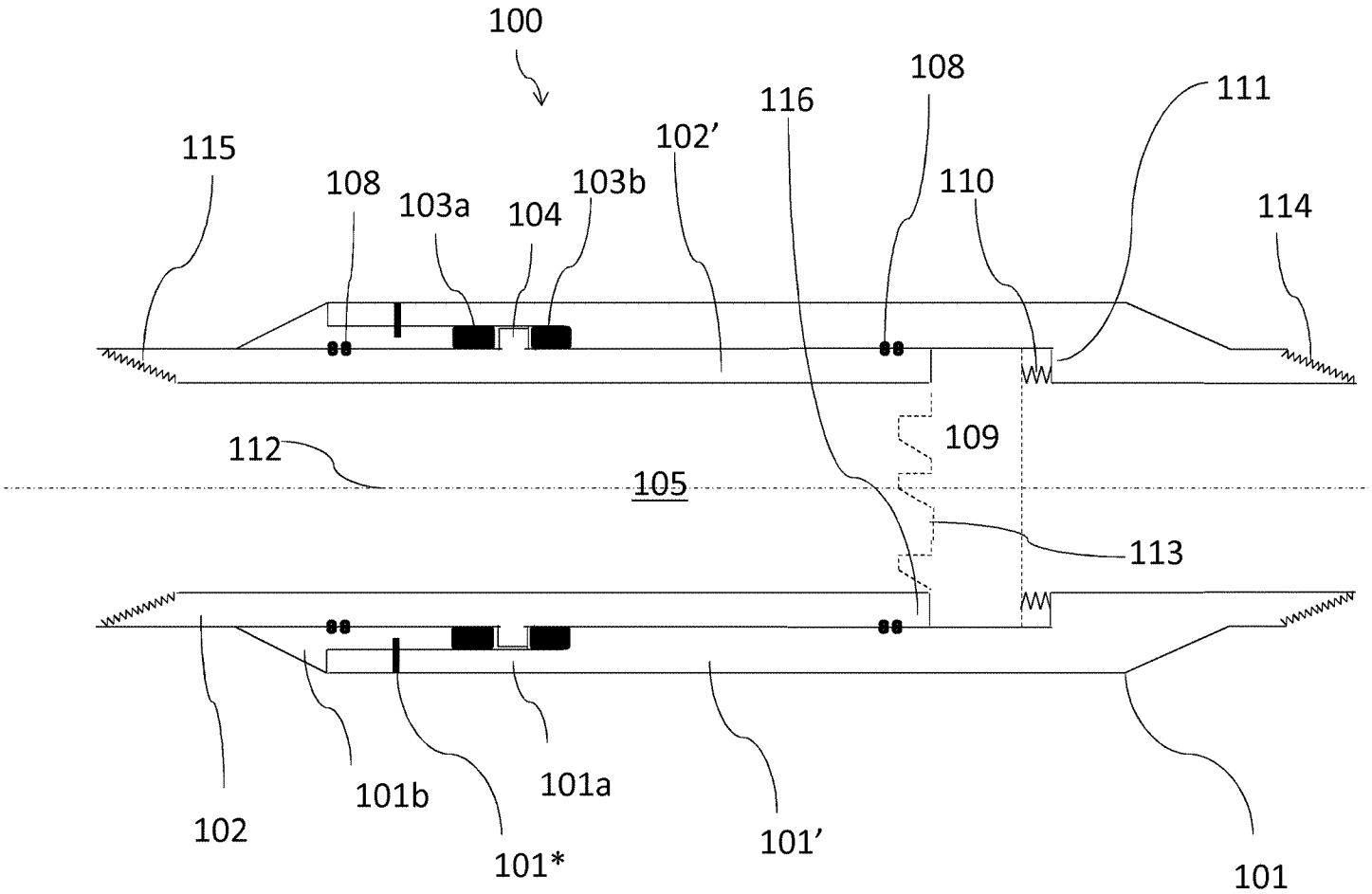
FIG. 1 shows a conceptual view of a longitudinal section of a swivel sub according to an embodiment of the present invention.

FIG. 1 shows a schematic longitudinal cross section of a swivel sub 100 according to a first embodiment of the present invention. The swivel sub according to the first embodiment comprises a first end 114 for connecting a first, bottom section of a string and a second end 115 for connecting a second, upper section of the string. The swivel sub 100 comprises:

- a first member 101, including a sleeve portion 101', the first member 101 comprising the first end 114, the first end being provided with connection means, for example a male threaded connection, for connecting a bottom section of a string;
- a second member 102 comprising a section 102' partially located within the sleeve portion 101', and having a first end 116 within the sleeve portion 101'. The second member further comprises the second end 115, the second end being provided with connection means, for example a female threaded connection, for connecting to the upper section of the string.

The first member 101 and the second member 102 are arranged to rotate relative to each other. Preferably, the first member 101 and the second member 102 are tubular. The first member and the second member 102 define a longitudinal bore 105 extending from the first end 114 to the second end 115 of the swivel sub 100.

In an embodiment of the present invention, the first member 101 is an assembly of at least a first part 101*a* comprising the first end 114 of the swivel sub, and a second part 101*b* opposite to the first end of the swivel sub 100. The first part 101*a* and the second part 101*b* are preferably fixed together by welding, brazing or by a fastening means 101*, for example by threads or by screw and nut assembly. Preferably, the first part 101*a* and the second part 101*b* form a sleeve portion 101'. The second member 102 comprises annular section of enlarged external diameter forming a shoulder 104. The sleeve portion 101' formed by the first part 101*a* and by the second part 101*b* of the first member 101, comprises an inner recess enclosing a first thrust bearing 103*a*, the shoulder 104 of the second member 102 and a second thrust bearing 103*b* separated from the first thrust bearing 103*a* by the shoulder 104 of the second member 102.

Preferably, the bore 105 of the swivel sub 100 is sealed from the external environment. Seals 108 are provided at the interface between the first member 101 and the second member 102.

The swivel sub 100 is characterized in that it further comprises a freewheel located inside the sleeve portion 101' and arranged such that:

- the freewheel allows the rotation of the second member 102 relative to the first member 101 upon rotation of the second member 102 in a first direction, and;
- the freewheel engages the first member 101 with the second member 102 upon rotation of the second member 102 in the direction opposite to the first direction (the second direction).

In the first embodiment of the invention as presented in FIG. 1, the freewheel of the swivel sub 100 comprises a one-way clutch element 109 having a first saw-toothed axial end 113, mating with the first complementarily shaped saw-toothed axial end 116 of the section 102' of the second member 102 located within the sleeve portion 101' of the first member 101. The one-way clutch element 109 is movable between the first end 116 of the section 102' of the second member 102 and an inner shoulder 111 comprised inside the sleeve portion 101' of the first member 101. The one-way clutch element 109 is maintained against the second member 102 by a spring 110 fixed on the shoulder 111. A spline coupling (not shown) is provided between the one-way clutch element 109 and the inner wall of the sleeve portion 101' of the first member 101 for allowing the one-way clutch element 109 to move along the longitudinal axis 112 of the swivel sub. Preferably, the saw-toothed axial end 116 of the section 102' of the second member 102 and the saw-toothed axial end 113 of the one-way clutch element 109 are shaped so as to engage with each other only in a unique relative rotational position. That way, the freewheel permits a limited rotation (between 0 and 360° at most, depending on the initial relative position) of the second member 102 in the second direction without that the first member 101 is engaged.

The string is preferably lowered down into the wellbore while it is rotated to the right (clockwise direction, when looking from top to bottom) to overcome friction forces. When the upper section of the string is rotated to the left, the one-way clutch engages the first and second members of the swivel sub, and some detachable (right-hand) threaded connection, for example a back off sub comprising a locking mechanism unlockable by a applying a pressure differential, (above or below the tool) will back off if the string section below the threaded connection is stuck both axially and in rotation. The one-way clutch also allows orienting the casing rotationally to the left if required (unless a detachable connection above the casing backs off due to the rotation).

Figure 2:
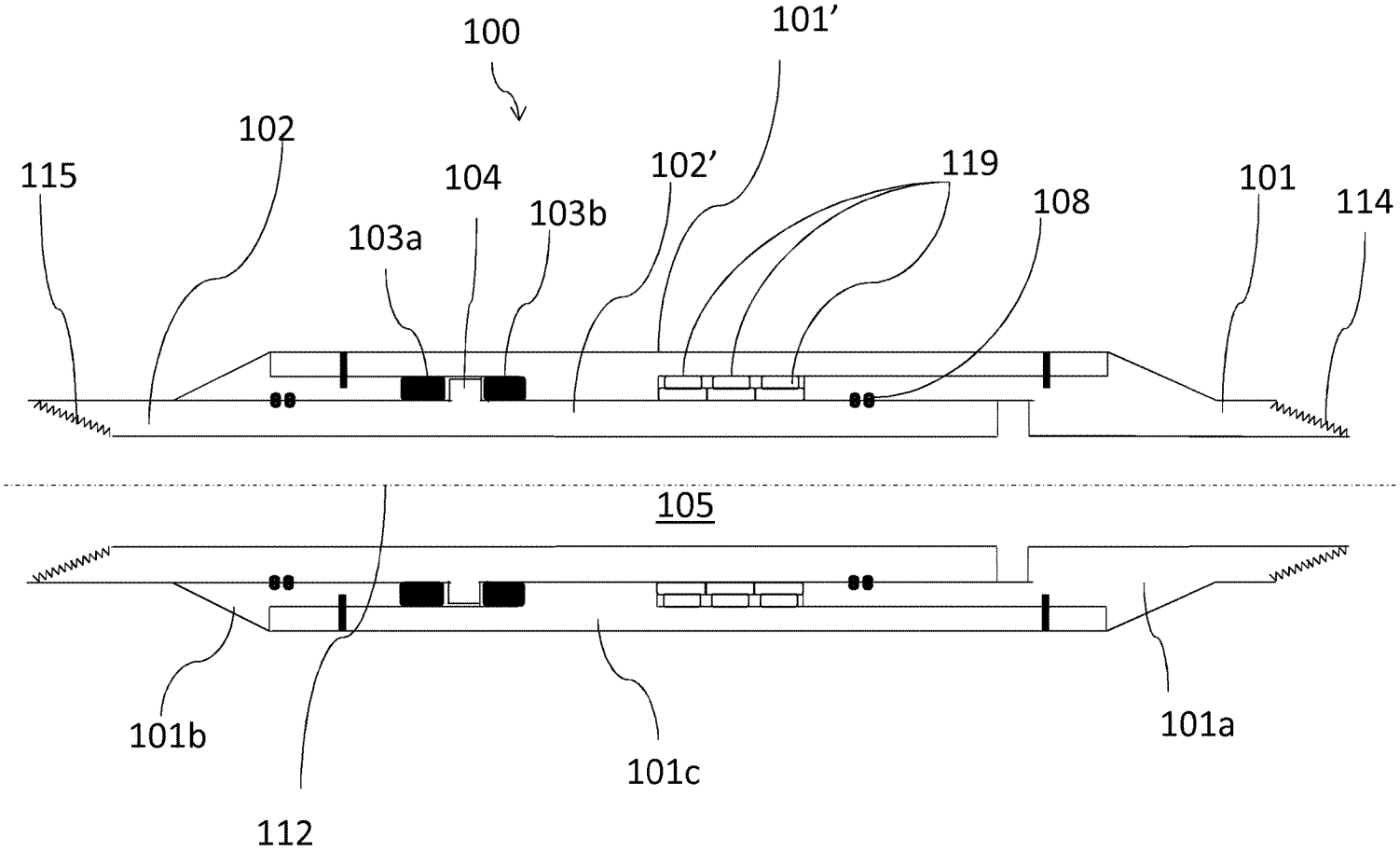
FIG. 2 shows a conceptual view of a longitudinal section of a swivel sub according to a second embodiment of the present invention.

FIG. 2 shows a schematic longitudinal cross section of a swivel sub 100 according to a second embodiment of the present invention. The swivel sub according to the second embodiment comprises a first end 114 for connecting a first bottom section of a string and a second end 115 for connecting a second upper section of the string.

The swivel sub 100 comprises:

- a first member 101, including a sleeve portion 101', the first member 101 comprises the first end 114, the first end 114 being provided with connection means, for example a male threaded connection, for connecting a bottom section of a string;
- a second member 102 comprising a section 102' partially located within the sleeve portion 101', and having a first end 116 within the sleeve portion 101'. The second member further comprises a second end, which is also the second end 115 of the swivel sub, the second end being provided with connection means, for example a female threaded connection, for connecting to the upper section of the string.

The first member 101 and the second member 102 are arranged to rotate relative to each other around a rotation axis 112. The first member 101 and the second member 102 define a longitudinal bore 105 extending from the first end 114 to the second end 115 of the swivel sub 100.

Preferably, the bore 105 of the swivel sub 100 is sealed from the external environment. Seals 108 are provided at the interface between the first member 101 and the second member 102.

The swivel sub 100 is characterized in that it further comprises a freewheel located inside the sleeve portion 101' and arranged such that:

- the freewheel allows a rotation of the second member 102 relative to the first member 101 upon rotation of the second member 102 in a first direction, and;
- the freewheel engages the first member 101 with the second member 102 upon rotation of the second member 102 in the direction opposite to the first direction.

In the second embodiment of the invention presented in FIG. 2, the freewheel of the swivel sub 100 is a sprag clutch 119 arranged between the sleeve portion 101' and the external wall of section 102' of the second member 102 included in the sleeve portion 101'. Preferably a stack of sprag clutches is provided between the sleeve portion 101' of the first member 101 and the second member 102. In a preferred embodiment of the invention, the stack of sprag clutches comprises three sprag clutches.

Preferably, first member 101 comprises an assembly of a first part 101*a* comprising the first end 114 of the swivel sub, a second part 101*b* opposite to the first end 114, the first part 101*a* and the second part 101*b* being joined together by a third part 101*c*. Preferably, the first part 101*a*, the second part 101*b* and the third part 101*c* are fixed together by welding, brazing or by fastening means 101*, for example by threads or by screw and nut assembly. The second member 102 comprises a section of enlarged external diameter forming a shoulder 104. The first part 101*a*, the second part 101*b* and the third part 101*c* form the sleeve portion 101'. The assembly of the first part 101*a* with the third part 101*c* comprises a first inner recess enclosing the sprag clutch or the stack of sprag clutches 119. The assembly of the second part 101*b* with the third part 101*c* comprises a second inner recess enclosing a first bearing 103*a*, the shoulder 104 of the second member 102 and a second thrust bearing 103*b* separated from the first thrust bearing 103*a* by the shoulder 104 of the second member 102.

The string is preferably lowered down into the wellbore while it is rotated to the right (clockwise direction, when looking from top to bottom) to overcome friction forces. When the upper section of the string is rotated to the left, the sprag clutch engages the first and second members of the swivel sub, and some detachable (right-hand) threaded connection, for example a back off sub comprising a locking mechanism unlockable by a applying a pressure differential, (above or below the tool) will back off if the string section below the threaded connection is stuck both axially and in rotation. The sprag clutch also allows orienting the casing rotationally to the left if required (unless a detachable connection above the casing backs off due to the rotation).

Figure 3:
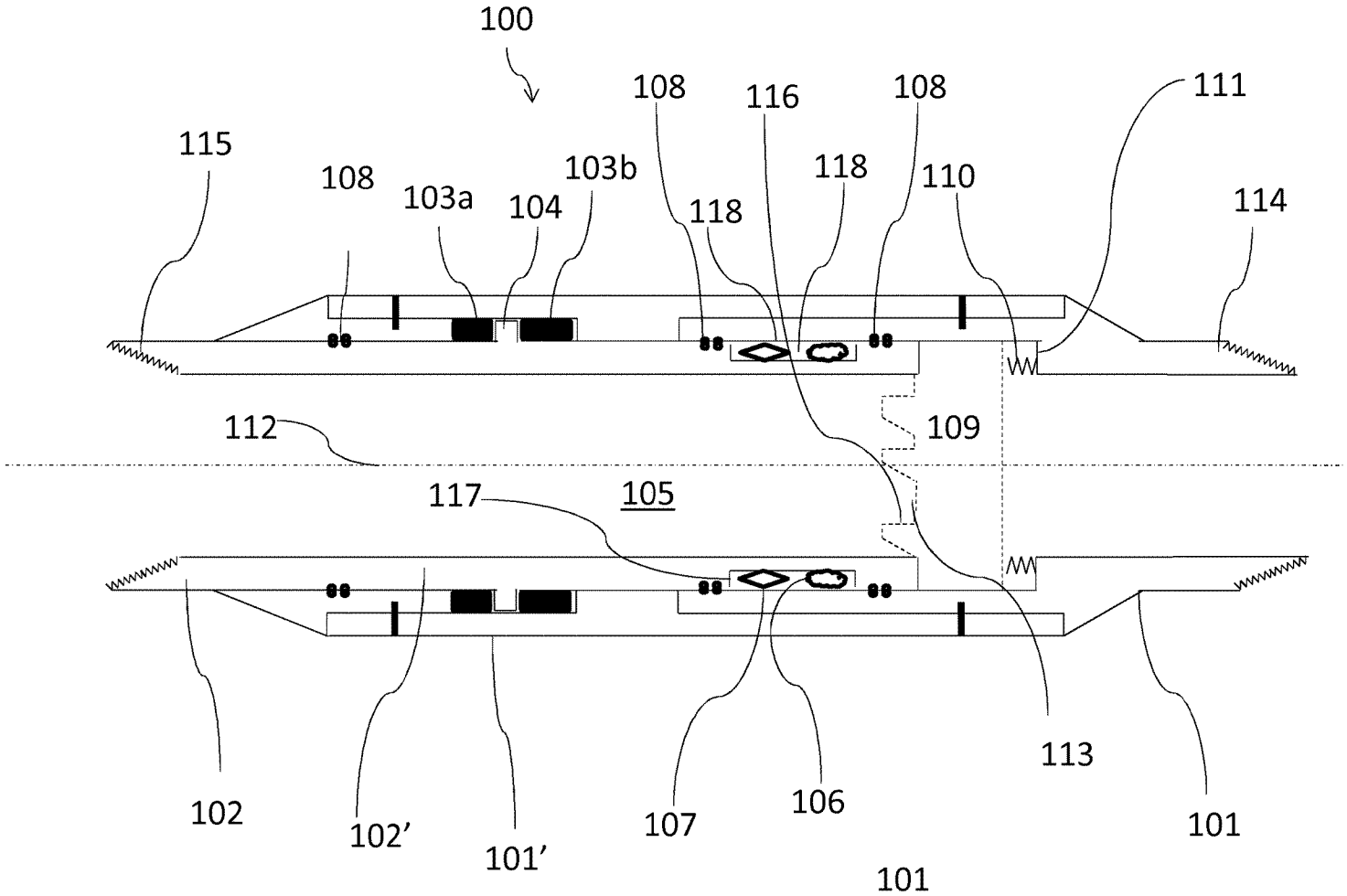
FIG. 3 shows a conceptual view of a longitudinal section of a swivel sub according to a third embodiment of the present invention.
Figure 4:
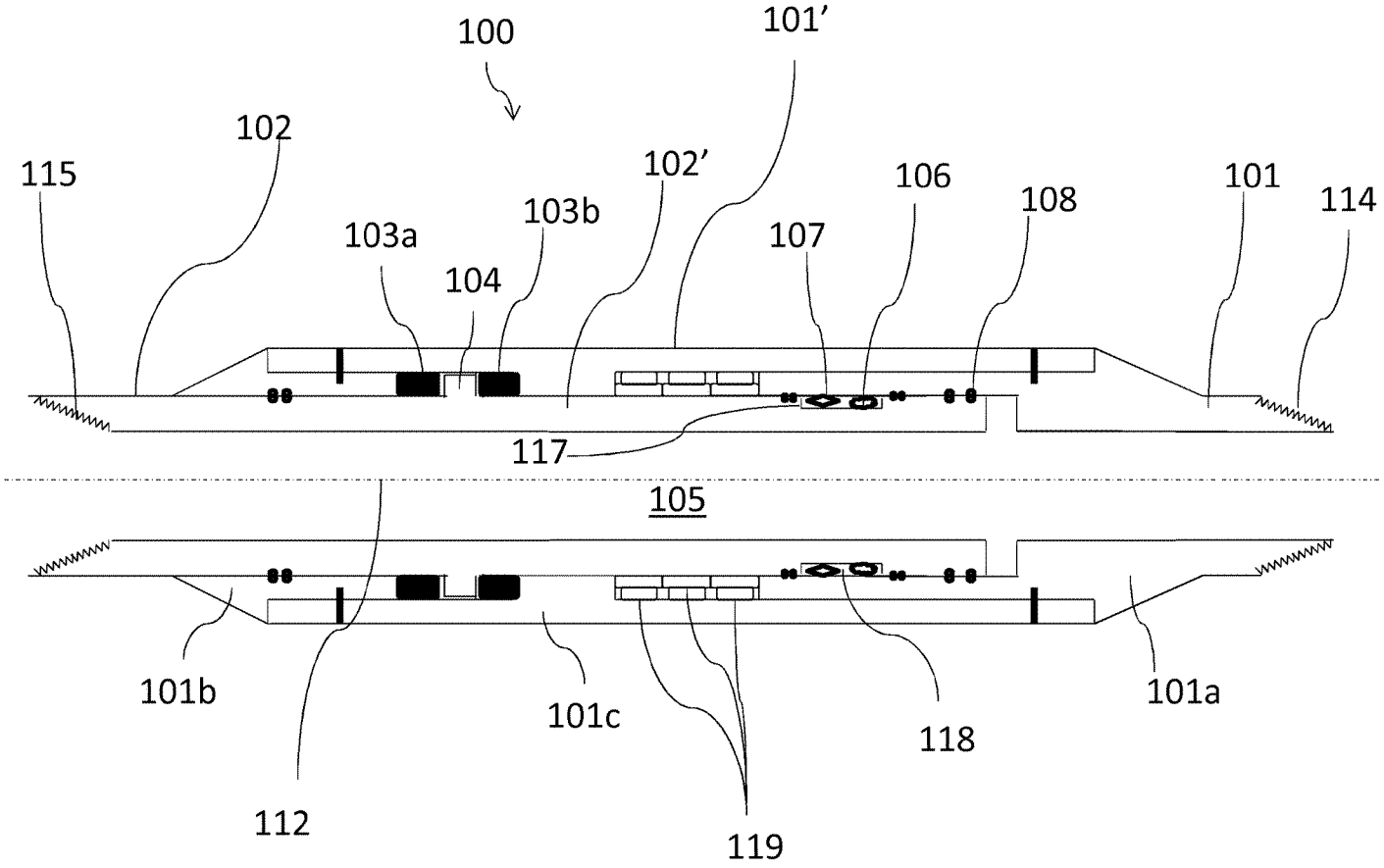
FIG. 4 shows a conceptual view of a longitudinal section of a swivel sub according to a fourth embodiment of the present invention.

FIG. 3 and FIG. 4 show variants of the embodiments of FIG. 1 and FIG. 2, respectively, wherein the swivel sub 100 further comprises an operable sealing system at the interface between the sleeve portion 101' of the first member 101 and the second member 102. Advantageously, the operable sealing system is located between two rotary seals 108. More advantageously, the operable sealing system is located near the first end 116 of the second cylindrical body 102 comprised in the sleeve portion 101'. More preferably such an operable sealing system is provided in a swivel sub destined to be included in a production tubing.

Preferably, the sealing system comprises an element capable of swelling 106 as an operable sealing safety means that swells in contact of a liquid, for example a fluid from the production zone. The swelling element provides a safety sealing between the first cylindrical body 101 and the second cylindrical body 102. In case of constraints on the swivel sub creating passages between the first cylindrical body 101 and the second body 102 and/or in case of the failure of the rotary seals 108, the element capable of swelling 106 swells and thereby compensates loss of tightness between the first cylindrical body and the second cylindrical body.

Alternatively or additionally, the operable sealing system comprises a compression seal 107 as a means of sealing that expands radially to compensate any loss of tightness between the first cylindrical body 101 and the second cylindrical body 102. The compression seal 107 may be activated under the action of a flow of liquid, for example a fluid coming from the oil well, by an actuator or any other device that can be envisaged by the man skilled in the art. In case of constraints on the swivel sub creating passages between the first cylindrical body 101 and the second cylindrical body 102 and/or in case of failure of the rotary seals 108, the compression seal 107 is activated. The compression seal 107 can be, for example, a stack of V-shaped rings also known as chevron seal or any other suitable compression seal known by the man skilled in the art. The compression seal 107 is advantageously maintained in a recess 118 comprised between the first cylindrical body 101 and the second tubular body 102. The recess 118 may be formed in one or both of the first and second cylindrical bodies 101, 102. The recess 118 is axially delimited by an annular end face 117, against which the compression seal 107 can abut and which thereby provides the reaction force necessary for the radial expansion of the seal when subjected to axial compression. Preferably, the compression seal 107 is made of metallic pieces and provides a metal-to-metal seal with the external wall of the second tubular portion 102 and the sleeve portion 101', respectively.

If the operable sealing system comprises both an element capable of swelling 106 and a compression seal 107, both element capable of swelling 106 and compression seal 107 can be arranged in the recess 118 to work independently from each other such that when one of these sealing means fails to provide the tightness, the second sealing means is activated. The element capable of swelling 106 and the compression seal 107 can also be arranged in the recess 118 so as to work as a unit. In that case, when the element capable of swelling 106 is activated, it expands radially for providing a first sealing and axially for activating the compression seal 107, which thereby provides a second safety seal.

According to a second aspect of the invention, a method of operation in a wellbore is provided. Preferably, the method of operation includes a step of deploying a string within the wellbore. The string may be a string including a liner, a casing string, a production tubing, or a string having a bottom section provided with a downhole tool. The first end 114 of the swivel sub 100 according to one of the embodiments presented hereinabove is connected to a bottom section of the string, the second end 115 of the swivel sub 100 is connected to an upper section of the string, and the upper section of the string is rotated in a first direction while the string is lowered down into the wellbore. The swivel sub 100 allows the upper section of the string to rotate relative to the bottom section of the string, whereby the drag between the upper section of the string and the wall of the wellbore is reduced.

The bottom section of the string may be a liner, a bottom section of a liner, a bottom section of a casing string, a sand control screen, a bottom section of a production string or a bottom section of a string comprising a tool such as a sand control screen, a completion tool, a perforating tool etc.

While the string is deployed within the wellbore, the upper section is rotated in a first direction such that the upper section rotates relative to the bottom section for reducing the drag between the upper section of the string and the walls of the wellbore, facilitating deployment of the string, and for preventing damage to the parts of the bottom section resulting from excessive torque on the string.

Preferably, the bottom section of the string or liner is kept short with respect to the upper section of the string or liner. For example, the bottom section of the string or liner may comprise a tool and an assembly of less than 10 pipes having each one a length comprised between 10 and 40 meters, while the upper section of the string or liner may exceed one kilometer when the wellbore has reached its maximum depth.

Preferably, the swivel sub 100 comprises a freewheel and the upper section of the string is equipped with a release mechanism for disconnecting components of the upper section of the string, the release mechanism being operable upon rotation of the string in the opposite direction of the first direction (designated herein as the "second direction").

When it is required to disconnect components of the string (e.g. the liner at the bottom end of the wellbore), the string is rotated in the second direction such that the freewheel engages the first member of the swivel sub connected to the lower part of the string with the second member of the swivel sub. As the first and second members of the swivel sub are blocked in rotation relative to each other, reverse rotation of the section of the string comprised between the release mechanism and the bottom of the string is impeded due to increased friction, and operation of the release mechanism for disconnecting the components of the string is thus allowed.

Preferably, when a casing string or a liner is deployed within the wellbore, the upper section of the string is provided by centralizers for centralizing the casing string or the liner within the wellbore such that a radial space between the wall of the wellbore and the string is substantially constant which provides a good distribution of cement around the casing string or the liner.

Preferably, the centralizer comprises means for reducing the drag between the external wall of the centralizer and the wall of the wellbore.

According to the method of the present invention, the string may be lowered into a highly deviated and deep wellbore. By the method of the present invention, it is, for example, possible to lower liners having an increased length compared to liners used in the methods of prior art.

In an embodiment of the method of the present invention, the string is a casing string and the method comprises a step of cementation of the casing, wherein cement is injected through the bore of the casing string including the swivel sub 100. The cement flows to the bottom end of the casing string and then passes through the annulus comprised between the external wall of the casing string and the wall of the wellbore. The upper string is rotated during the cementation process in order to achieve better distribution of the cement in the annulus and providing a better cementation of the casing string.

In an embodiment of the method of the present invention, the string is a liner attached to a workstring, the liner including the swivel sub 100 positioned preferably at a short distance from the bottom end of the liner, for example at a distance less than 100 or 200 meters, and the method further comprises a step of cementation of the liner, wherein cement is injected through the bore of the workstring and the liner including the swivel sub 100 to the bottom end of the liner, and then in the annulus comprised between the external wall of the liner and the wall of the wellbore. The upper string section is rotated during the cementation process to promote the distribution of the cement in the annulus and to provide a better cementation of the liner. Preferably, lowering down the liner with the workstring and cementation of the liner is performed after cementation of a casing string comprising a swivel sub 100 according to the first aspect of the invention, and the step of cementation of the casing string is performed while rotating an upper section of the casing string.

In an embodiment of the method of the present invention, the string lowered down in the wellbore is a workstring comprising a bottom end or a bottom section provided with a tool, for example a screen, a packer, a gravel packer assembly, a perforating tool, or any other tool that can be envisaged by the man skilled in the art, the tool being attached to a workstring that comprises the swivel sub 100. The step of lowering down such a string is performed after the casing and the liner have been cemented within the wellbore. The method further comprises a step of operating the tool.

In an embodiment of the method of the present invention, the string lowered down in the wellbore is a production tubing comprising the swivel sub of the invention.

The advantages provided by the use of the downhole sub 100 in the method of the present invention are that the lowering of a string into a deviated to highly deviated wellbore is facilitated with reduced risk of damaging the bottom section of the string. The swivel sub allows rotation of an extended string within a horizontal wellbore section, allowing a better circulation of cement during the step of cementation. Cementation by rotating the part of the string upper the swivel sub 100 provides a good cementation of the casing and thereby an efficient sealing of the casing. The swivel sub is allowed to be cemented with the bottom section and the upper section of the casing string or liner. The swivel sub is therefore allowed to be let down in the wellbore for the whole life of exploitation of the wellbore. The swivel sub 100 placed in a production string also provides the facility of insertion of the production tubing within the wellbore, with reduced risk of leaks at the level of the swivel sub 100. The risk of loss of tightness of the swivel sub is reduced with a sealing system as described in the present disclosure.

What is claimed is:

1. A method of operation in a wellbore, including a step of deploying a string within said wellbore, wherein a swivel sub is provided, said swivel sub comprising:

a first end provided with connection means for connecting a bottom section of a string;

a second end provided with connection means for connecting an upper section of the string;

a first member, including said first end and a sleeve portion opposed to said first end;

a second member including said second end and comprising a section opposed to said second end and partially located within the sleeve portion, the second member being arranged to rotate relative to the first member; and a freewheel located inside the sleeve portion between said first member and said second member, the freewheel being arranged such that:

said freewheel allows rotation of the second member relative to said first member upon rotation of said second member in a first direction, and said freewheel engages the said first member with said second member upon rotation of the said second member in a direction opposite to said first direction, wherein the first end of said swivel sub is connected to a bottom section of the string, the second end of said swivel sub is connected to an upper section of the string, and the upper section of the string is rotated in a first direction during deployment of said string in the wellbore while said bottom section is not rotating.

2. The method of operation in a wellbore according to claim 1, wherein said string is a casing string and wherein the method comprises a step of cementation of said casing string, during which said upper section of the casing string connected to said swivel sub is rotated.

3. The method of operation in a wellbore according to claim 1, wherein said string is provided with a centralizer comprising means for reducing drag between a wall of the wellbore and a radially external surface of the centralizer or between a radially internal wall of a casing and the radially external surface of the centralizer.

4. The method of operation in a wellbore according to claim 1, wherein said string is a liner and wherein said method comprises a step of cementation of said liner, during which said upper section of said liner connected to said swivel sub is rotated.

5. The method of operation in a wellbore according to claim 1, wherein said swivel sub is cemented within the wellbore.

6. The method of operation in a wellbore according to claim 1, wherein said string comprises a downhole tool located at a bottom end of said string and wherein said method comprises a step of deploying said downhole tool at a predetermined location of the wellbore.

7. The method of operation in a wellbore according to claim 1, wherein said swivel sub comprises a freewheel and wherein said upper section of the string is equipped with a release mechanism which is operated when required by rotating an upper part of said upper section in a second direction opposite to said first direction.

8. A swivel sub for a string to be lowered into a wellbore, the swivel sub comprising:

a first end provided with connection means for connecting a bottom section of a string;

a second end provided with connection means for connecting an upper section of the string;

a first member, including said first end and a sleeve portion opposed to said first end;

a second member including said second end and comprising a section opposed to said second end and partially located within the sleeve portion, the second member being arranged to rotate relative to the first member; and a freewheel located inside the sleeve portion between said first member and said second member, the freewheel being arranged such that:

said freewheel allows rotation of the second member relative to said first member upon rotation of said second member in a first direction, and said freewheel engages the said first member with said second member upon rotation of the said second member in a direction opposite to said first direction.

9. The swivel sub according to claim 8, wherein said first member and said second member are tubular members, both first member and second member defining a bore extending from the first end to the second end of the swivel sub, the swivel sub further comprising sealing means located between said sleeve portion of the first tubular member and said section of said second tubular member for sealing said bore from the external environment.

10. The swivel sub according to claim 8, further comprising thrust bearings arranged between said sleeve portion of the first member and said section of said second member.

11. The swivel sub according to claim 8, further comprising a one-way clutch element having a first saw-toothed axial end mating with a second saw-toothed axial end formed in said section of the second member located within said sleeve portion of the first member.

12. The swivel sub according to claim 8, further comprising a sprag clutch arranged between said first member and said second member-.

13. The swivel sub according to claim 12, further comprising an operable sealing system at the interface between said sleeve portion of the first tubular member and said section of the second tubular member inside said sleeve portion.

* * * * *